US005881335A

United States Patent [19]

Yang

[11] Patent Number: 5,881,335

[45] Date of Patent: Mar. 9, 1999

[54] GRADATIONAL POWER SAVING TECHNIQUE FOR ELECTROPHOTOGRAPHIC IMAGE FORMING APPARATUS

[75] Inventor: Seung-Bae Yang, Seoul, Rep. of Korea

[73] Assignee: SamSung Electronics Co., Ltd., Suwon, Rep. of Korea

[21] Appl. No.: 861,011

[22] Filed: May 21, 1997

[30] Foreign Application Priority Data

May 21, 1996 [KR] Rep. of Korea ..... 1996-17273

[51] Int. Cl.[6] ..... G03G 15/20

[52] U.S. Cl. ..... 399/70; 399/69

[58] Field of Search ..... 399/67, 69, 70, 399/88, 90, 320, 328, 330, 335

[56] References Cited

U.S. PATENT DOCUMENTS 4,618,245 10/1986 Fukushi et al. .
4,878,092 10/1989 Arai .
5,109,255 4/1992 Nishikawa et al. .
5,241,349 8/1993 Nagasaka .
5,317,367 5/1994 Pierce et al. .
5,321,428 6/1994 Dornier .
5,321,478 6/1994 Nakamura et al. ..... 399/70
5,321,479 6/1994 Yoshida et al. .
5,464,964 11/1995 Okuda et al. .
5,465,141 11/1995 Ashano et al. .
5,489,935 2/1996 Dornier .
5,528,346 6/1996 Kim et al. .
5,534,987 7/1996 Ohtsuka et al. .
5,589,923 12/1996 Lee et al. .
5,600,406 2/1997 Aikawa et al. .
5,652,950 7/1997 Kim ..... 399/70

*Primary Examiner*—Sandra Brase
*Attorney, Agent, or Firm*—Robert E. Bushnell, Esq.

[57] ABSTRACT

An electrophotographic image forming apparatus employs a gradational power saving mode for reducing power consumption step by step with the passage of a print-waiting time. The apparatus raises a fixing temperature up to a print-waiting temperature when the image forming apparatus is turned on. When the fixing temperature reaches the print-waiting temperature, the print-waiting time is counted and compared with reference values which are preset into multiple gradations. Then, the fixing temperature is reduced to a temperature corresponding to the reference values step by step, if the counting value is equal to or greater than the reference values.

11 Claims, 4 Drawing Sheets

GRADATIONAL POWER SAVING TECHNIQUE FOR ELECTROPHOTOGRAPHIC IMAGE FORMING APPARATUS

CLAIM OF PRIORITY

This application makes reference to, incorporates the same herein, and claims all benefits accruing under 35 U.S.C. §119 from an application for GRADATIONAL POWER SAVING METHOD OF ELECTROPHOTOGRAPHIC IMAGE FORMING APPARATUS earlier filed in the Korean Industrial Property Office on the 21$^{st}$ day of May 1996 and there duly assigned Serial No. 17273/1996, a copy of which application is annexed hereto.

BACKGROUND OF THE INVENTION

1. Field of the Invention

The present invention relates to a power saving technique for an electrophotographic image forming apparatus, and more particularly a gradational power saving technique for reducing power consumption step by step with the passage of a print-waiting time.

2. Description of the Related Art

An electrophotographic image forming apparatus, such as a laser printer and copying machine, maintains a constant fixing temperature near to a printing temperature during a print-waiting state, in order to quickly restart a printing operation. The laser printer or the coping machine utilizes a heat lamp for providing a high temperature during a process of fixing a toner on a paper. As stated above, since the heat lamp is continuously turned on, power consumption is undesirably increased. However, in the electrophotographic image forming apparatus, the print-waiting time is normally much longer than an actual printing time. Nevertheless, the heat lamp is continuously heated even during the print-waiting state, causing an unnecessary power consumption. Therefore, in order to solve such s problem, various techniques have been proposed. For example, an earlier electrophotographic image forming apparatus employs a power saving mode in which the heat lamp and a fan motor are completely turned off if a predetermined time has passed during the print-waiting state, in order to reduce the unnecessary power consumption.

A laser printer, which is a typical electrophotographic image forming apparatus, includes a video controller and an engine. The video controller includes a personal computer interface, a controller, an engine interface, an operating panel, a random access memory, and a read only memory. The personal computer interface interfaces an input/output signal with a personal computer. The controller performs data communication with the personal computer through the personal computer interface and controls the engine according to various control commands received from the personal computer and the operating panel so as to control the overall operation of the system. The engine interface interfaces an input/output signal with the engine under the control of the controller. The operating panel includes a plurality of keys for generating key data, provides the controller with the key data and displays display data generated by the controller. Under the control of the controller, the random access memory temporarily stores image data received from the personal computer interface and various data generated while the controller controls the printing operation. The read only memory stores software control programs for the controller. The engine, comprised of a driving mechanism for transferring the paper and printing the image data, controls the driving mechanism and an engine member according to the control of the control to perform the printing operation.

In the system noted above, the controller increases the fixing temperature of the engine up to a print waiting temperature and maintains the print waiting state. The controller checks whether or not the printing data or control command data has been received from the personal computer interface and the operating panel. If the printing data or the control command data has not been received, the controller counts the print waiting time to increase a counting value. This counting value is compared with a reference value for entering the power saving mode. If the counting value is less than the reference value, the process flow returns to the previous checking step of the controller and otherwise, if the counting value is equal to or greater than the reference value, the controller performs the power saving mode and then returns to the checking step. Meanwhile, if the printing data or the control command data has been generated, the controller resets the counting value and then a determination is made as to whether or not the current operation mode is the power saving mode. If it is not the power saving mode, a corresponding processing routine is performed. Namely, the controller performs an operation corresponding to the key input or pints the printing data. Otherwise, if it is the power saving mode, the controller repeats the previous step to increase fixing temperature of the engine up to the printing temperature and thereafter, the controller executes the processing routine step.

Unfortunately, in the above-noted system, the heat lamp is completely turned off in the power saving mode. While this saves power, it takes a considerable length of time, e.g., fifty seconds, for the printing temperature to reach its proper value when the system is switched from the power saving mode to the printing mode. This long delay creates considerable problems for the user.

The following patents each disclose features in common with the present invention but do not teach or suggest the incremental control of the print waiting temperature in accordance with the present invention.

U.S. Pat. No. 5,321,428 to Dornier, entitled Laser Printer Power Saver, U.S. Pat. No. 5,589,923 to Lee et al., entitled Power Saving Method Of An Image Forming Apparatus, U.S. Pat. No. 5,534,987 to Ohtsuka et al., entitled Fixing Apparatus With Variable Fixing Temperature, U.S. Pat. No. 4,618,245 to Fukushi et al., entitled Image Forming Apparatus And Attachment Which Together Enter An Energy Saving Mode, U.S. Pat. No. 5,465,141 to Asano et al., entitled Fixing Apparatus For changing The Duty Cycle Of Electric Current Supply, U.S. Pat. No. 5,317,367 to Pierce et al., entitled Thermal Realtime Clock, U.S. Pat. No. 5,489,935 to Dornier, entitled Laser Printer Power Saver, U.S. Pat. No. 5,600,406 to Aikawa et al., entitled Fixing Temperature Control Device, U.S. Pat. No. 4,878,092 to Arai, entitled Method Of Controlling A Fixing Unit Of An Image Forming Apparatus, U.S. Pat. No. 5,109,255 to Nishikawa et al., entitled Temperature Control System, U.S. Pat. No. 5,241,349 to Nagasaka, entitled Image Forming Apparatus Having A Plurality Of Control Modes Of Thermal Fixing Apparatus, U.S. Pat. No. 5,321,479 to Yoshida et al., entitled Electrophotographic Apparatus, U.S. Pat. No. 5,528,346 to Kim et al., entitled Power-Saving Printing Method Of A Printing System, and U.S. Pat. No. 5,464,964 to Okuda et al., entitled Image Heating Apparatus Changing Set Temperature In Accordance With Temperature Of Heater.

SUMMARY OF THE INVENTION

It is therefore an object of the present invention to provide a gradational power saving technique for reducing the power consumption step by step with the passage of a print-waiting time.

According to an aspect of the present invention, a method of saving power step by step in an electrophotographic image forming apparatus includes the steps of: raising a fixing temperature up to a print-waiting temperature when the electrophotographic image forming apparatus is turned on, and maintaining the print-waiting temperature; checking whether or not printing data or control command data has been received; increasing a counting value with a passage of a print-waiting time, if the printing data or control command data has not been received; comparing the counting value with reference values; setting a power saving mode to reduce power consumption to a value which is lower than a current power consumption, if the counting value is equal to or greater than the reference values; and increasing the fixing temperature up to a printing temperature to print or process the printing data and control command data, if the printing data or command data is received.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT(S)

Figure 1:
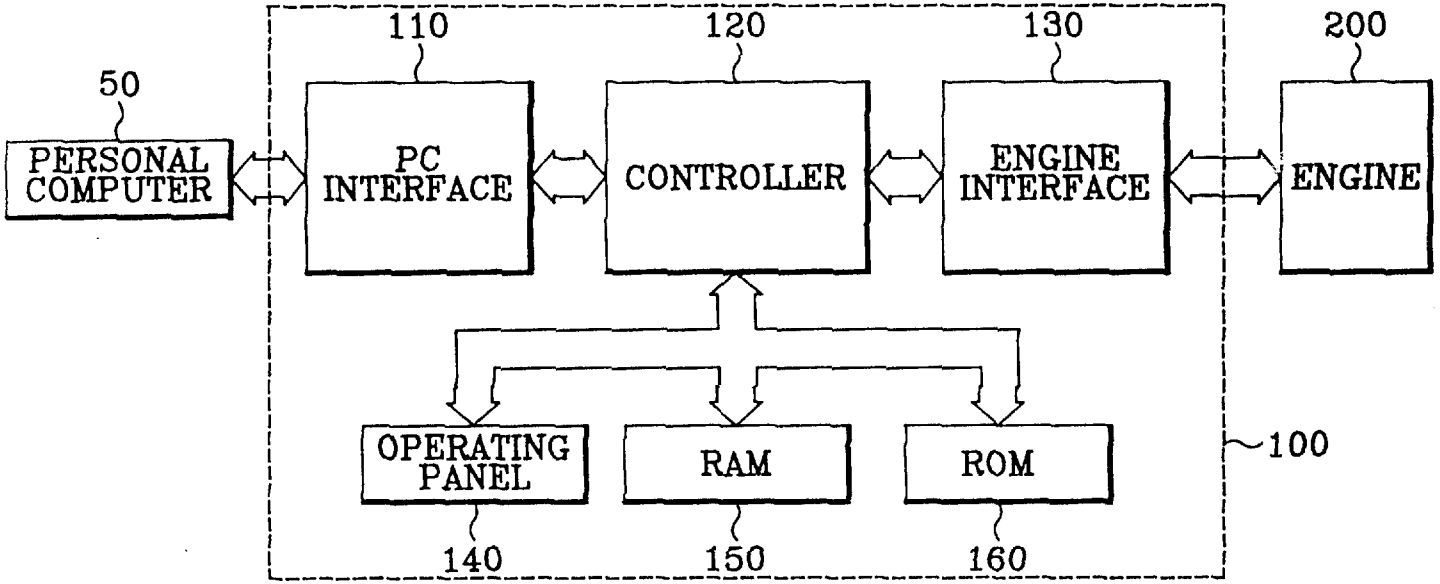
FIG. 1 is a system block diagram of a laser printer.

Referring to FIG. 1, there is illustrated a block diagram of a laser printer which is a typical electrophotographic image forming apparatus. As illustrated, the laser printer includes a video controller 100 and an engine 200. The video controller 100 includes a personal computer (PC) interface 110, a controller 120, an engine interface 130, an operating panel 140, a RAM (Random Access Memory) 150, and a ROM (Read Only Memory) 160. The PC interface 110 interfaces an input/output signal with a personal computer 50. The controller 120 performs data communication with the personal computer 50 through the PC interface 110, and controls the engine 200 according to various control commands received from the personal computer 50 and the operating panel 140, so as to control the overall operation of the system. The engine interface 130 interfaces an input/output signal with the engine 200 under the control of the controller 120. The operating panel 140 including a plurality of keys for generating key data, provides the controller 120 with the key data and displays display data generated by the controller 120. Under the control of the controller 120, the RAM 150 temporarily stores image data received from the PC interface 110 and various data generated while the controller 120 controls the printing operation. The ROM 160 stores software control programs for the controller 120. The engine 200, comprised of a driving mechanism (not shown) for transferring the paper and printing the image data, controls the driving mechanism and an engine member (not shown) according to the control of the controller 120, to perform the printing operation.

Figure 2:
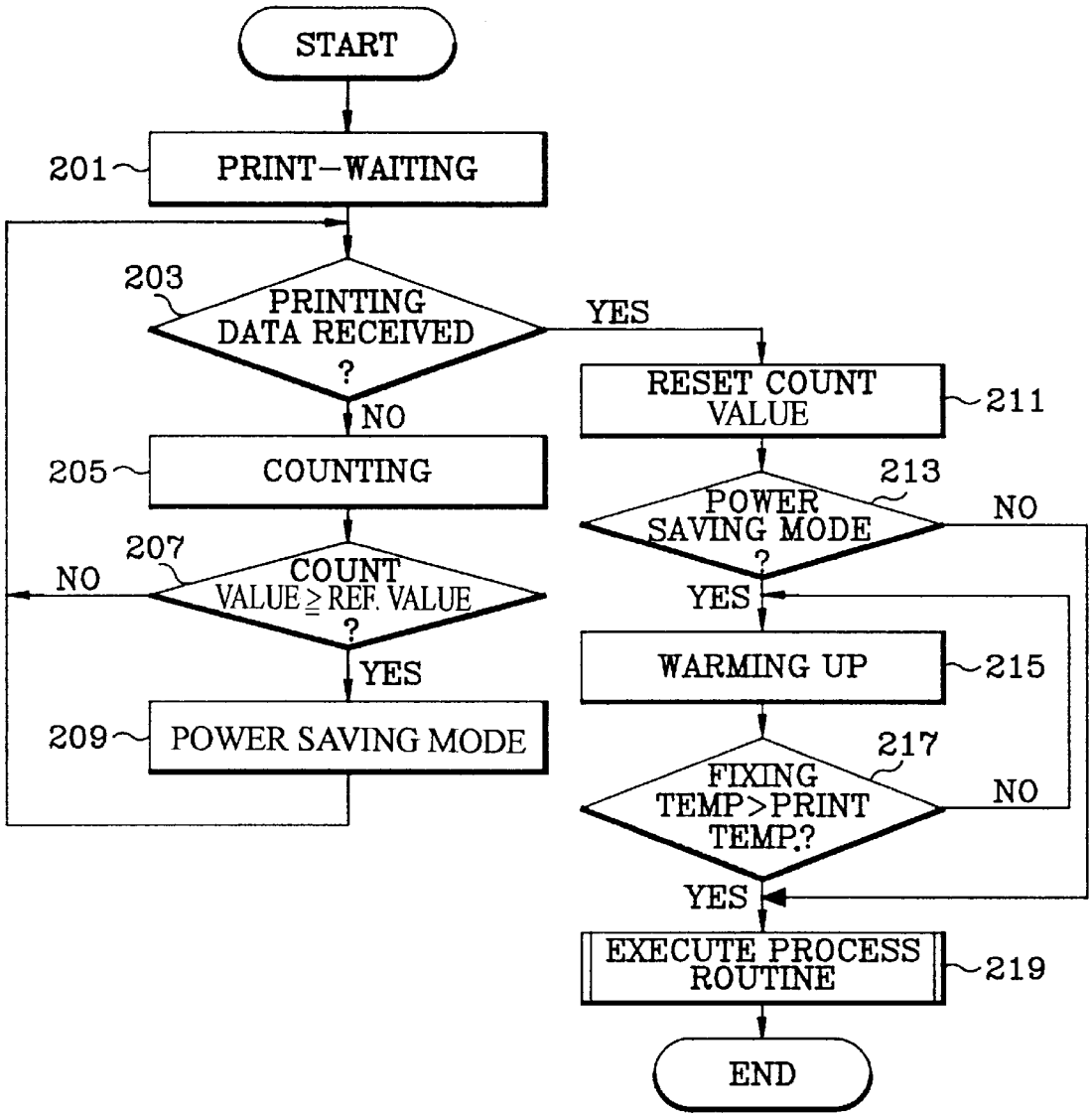
FIG. 2 is a flowchart for explaining an operation of an earlier power saving mode.

Referring to FIG. 2, there is illustrated a flowchart for explaining an earlier power saving mode employed with the laser printer shown in FIG. 1. The controller 120 increases the fixing temperature of the engine 200 up to the print-waiting temperature and maintains the print-waiting state, at step 201. The controller 120 checks, at step 203, whether or not the printing data or control command data has been received from the PC interface 110 and the operating panel 140. If the printing data or the control command data has not been received, the controller 120 counts the print-waiting time to increase a counting value, at step 205. The counting value is compared with a reference value for entering the power saving mode, at step 207. If the counting value is less than the reference value, the process flow returns to step 203. Otherwise, if the counting value is equal to or greater than the reference value, the controller 120 performs the power saving mode at step 209 and then, returns to the step 203. Meanwhile, if the printing data or the control command data has been generated at step 203, the controller 120 resets the counting value at a step 211. Then, it is checked, at step 213, whether or not the current operation mode is the power saving mode. If it is not the power saving mode, a corresponding processing routine is performed at step 219. Namely, the controller 120 performs an operation corresponding to the key input or prints the printing data. Otherwise, if it is the power saving mode, the controller 120 repeats steps 215 and 217 to increase the fixing temperature of the engine 200 up to the printing temperature. Thereafter, the controller 120 executes step 219.

Figure 3:
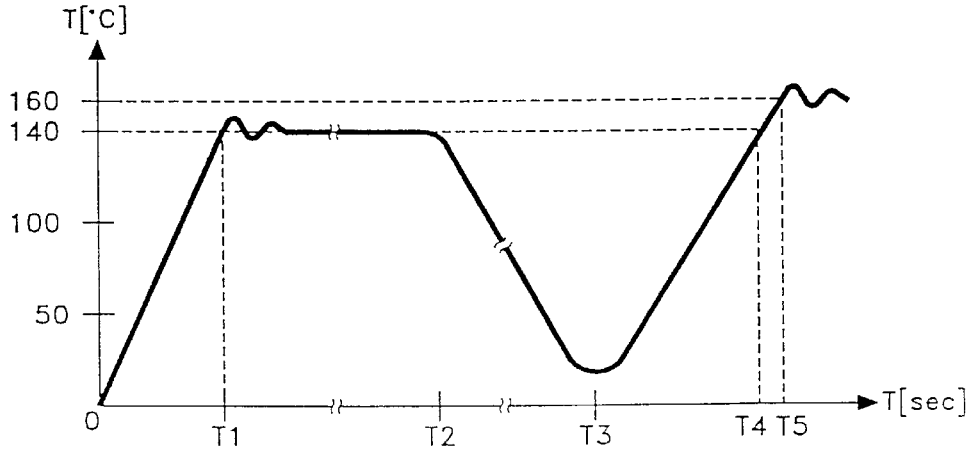
FIG. 3 is a curve showing the characteristics of a fixing temperature according to the earlier power saving mode.

Referring to FIG. 3, there is illustrated a curve showing the characteristics of the fixing temperature according to the an earlier power saving mode of the laser printer, in which the horizontal and vertical axes represent the time T[sec] and the fixing temperature T[°C.], respectively. As illustrated, if the laser printer is turned on, the controller 120 raises the fixing temperature up to a print-waiting temperature (about 140° C.) at step 215 of FIG. 2. An initial heating time T1 required for raising the fixing temperature up to the print-waiting temperature is normally about 60 sec, as shown in FIG. 3. Thereafter, the controller 120 begins to count the print-waiting time. If the counting value reaches the reference value at a time T2, the heat lamp is completely turned off to perform the power saving mode. With the passage of the print-waiting time, the fixing temperature is reduced to room temperature. If the printing data input or the control command data is received from the PC interface 110 or the operating panel 140 at a time T3, the controller 120 performs a wake-up process to enter the printing mode. A wake-up time (T5–T3) required for raising the fixing temperature up to the printing temperature (as represent by T5) is about 50 sec, which is almost the same as the initial heating time T1. Therefore, the earlier power saving method has a problem in that the power saving mode as well as the wake-up time are not adaptive to operating situations of the laser printer. Further, the wake-up time is constant and very long, which may bore the user. What is worse, the personal computer may cause a printing error due to the long print-waiting time.

A preferred embodiment of the present invention will be described in detail hereinbelow with reference to the attached drawings, in which like reference numerals used throughout the specification represent the elements. Further, it should be clearly understood by those skilled in the art that many specifics such as the detailed circuit elements are shown only by way of an example to bring a better understanding of the present invention and the present invention may be embodied without the specifics. Moreover, it should be noted that detailed descriptions the related art may have been intentionally omitted if it was believed to be unnecessary in describing the concepts of the present invention.

In general, a pause between the printing operations is very short when the printer user has many printing jobs. On the contrary, however, the pause becomes very long when the printer does not have many printing jobs. In the light of the foregoing, the present invention divides the power saving mode into three gradations to reduce the power supplied to the heat lamp step by step. For example, the power saving mode includes first to third gradational power saving modes, in which the power supplied to the heat lamp is reduced to about ⅔ of the normal fixing temperature in the first power saving mode, the power is reduced to about ⅓ of the normal fixing temperature in the second power saving mode, and the power is completely turned off in the third power saving mode. The first to third power saving modes are performed in sequence with the passage of the print-waiting time. For the convenience of explanation, it is assumed in the application that three reference values (T2, T5, and T8 as shown in FIG. 5) are given for the first to third power saving modes respectively, and the critical temperatures for entering the first to third modes are 100° C., 50° C., and 25° C., respectively.

Figure 5:
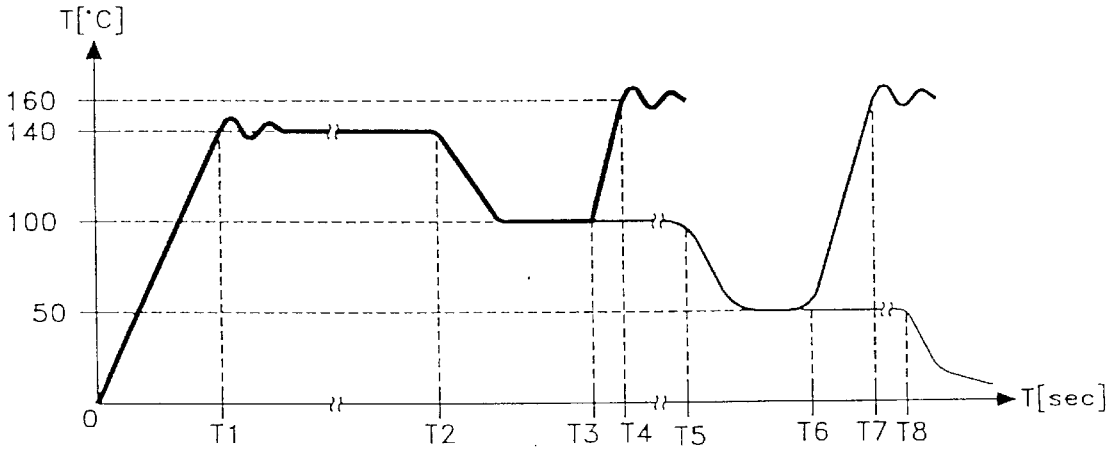
FIG. 5 curve showing the characteristics of a fixing temperature of a gradational power saving mode according to the present invention.
Figure 4:
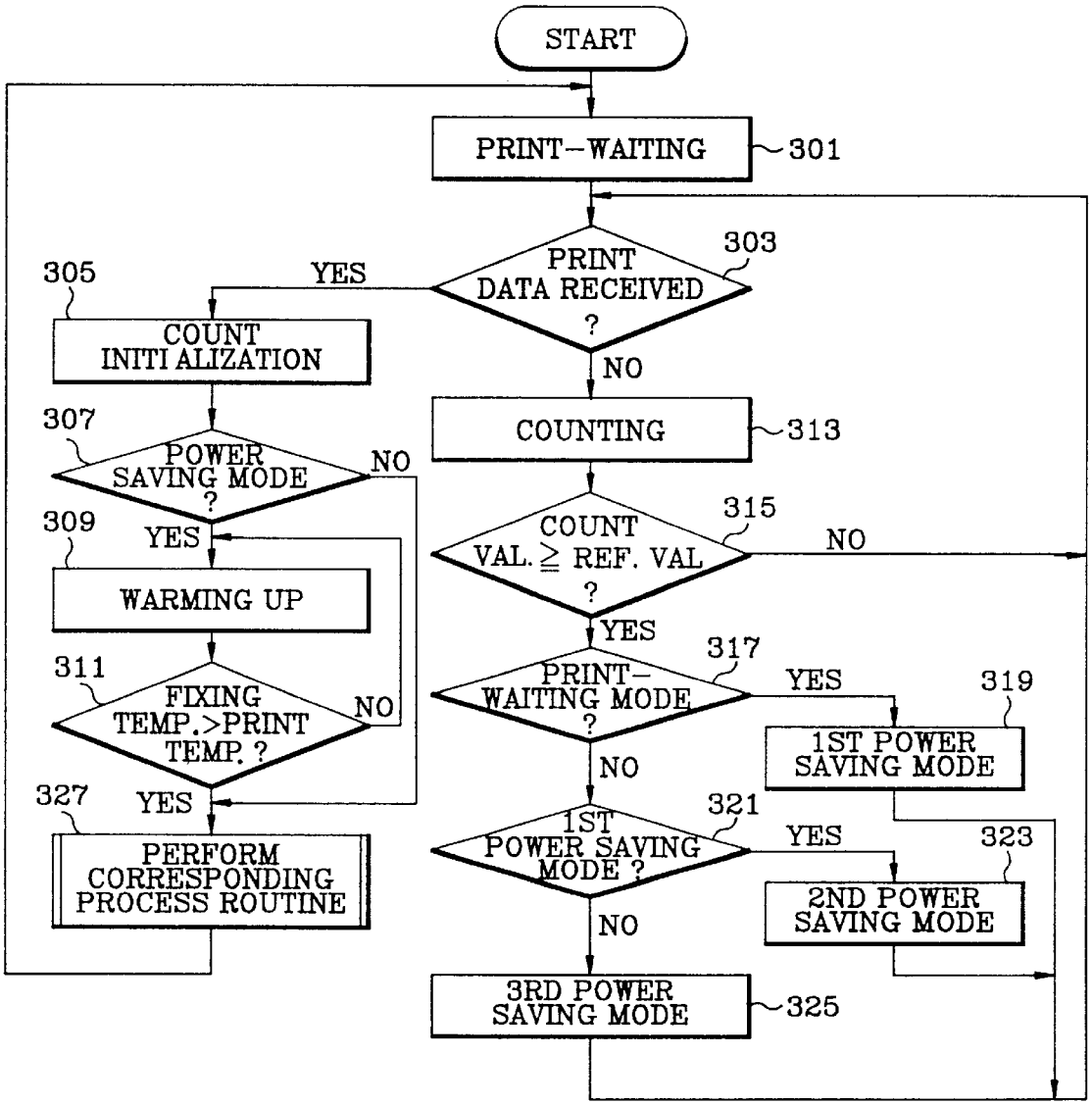
FIG. 4 is a flowchart for explaining an operation of a gradational power saving mode according to an embodiment of the present invention.

Referring to FIGS. 4 and 5, the operation of the present invention will be described in detail hereinbelow. As the laser printer is turned on, the controller 120 controls the engine 200 to raise the fixing temperature up to the print-waiting temperature (about 140° C.) and maintains the print-waiting state, at step 301. Then, the controller 120 counts the print-waiting time beginning at a time T1. Thereafter, the controller 120 checks, at step 303, whether or not the printing data or the control command data has been received from the PC interface 110 and the operating panel 140. If the printing data or the control command data has been received, the controller 120 initializes the current counting value at step 305, and checks whether or not the current operation mode is the power saving mode at step 307. If it is not the power saving mode, the process flow proceeds to step 327 to execute a corresponding processing routine. Otherwise, if it is the power saving mode, the controller 120 warms up the engine 200 at step 309, and compares the current fixing temperature with the printing temperature (e.g., 160° C.) at a step 311. If the current fixing temperature is higher than the printing temperature, the controller 120 executes the corresponding process routine at step 327.

Meanwhile, if the printing data or the control command data is not generated at step 303, the controller 120 continues to count the print-waiting time to increase the counting value at step 313. Then, the counting value is compared with a reference value T2 corresponding to the critical value for entering the first power saving mode, at step 315. If the counting value is less than the reference value T2, the process flow returns to step 303. If, however, the counting value is equal to or greater than the reference value T2, the controller 120 checks whether or not the current operation mode is the power saving mode at step 317. If the current operation mode is the power saving mode, the controller 120 sets the current operation mode to the first power saving mode and performs the first power saving mode at step 319. Namely, in the first power saving mode, the controller 120 turns off the heat lamp at the time T2 to reduce the fixing temperature, if the counting value is equal to or greater than the reference value T2. Then, the controller 120 controls the heat lamp to maintain the temperature of 100° C. which has been preset for the first power saving mode. Thereafter, the process flow returns to step 303 and maintains the first power saving mode. Meanwhile, if the printing data or the control command data is received from the PC interface 110 or the operating panel 140 at a time T3, the controller 120 executes the foregoing steps 305 to 327, so that the wake-up time (T4–T3) may be reduced.

After a while, if the printing data or the control command data has still not been generated at step 303, the controller 120 continues to count the print-waiting time to increase the counting value at step 313. Thereafter, if the counting value is equal to or greater than the reference value T5 which has been preset for the second power saving mode, the process flow proceeds to step 323 via steps 317 and 321. At step 323, the controller 120 sets the current operation mode to the second power saving mode and executes the second power saving mode. Namely, in the second power saving mode, the controller 120 turns off the heat lamp at the time T5 to reduce the fixing temperature, if the counting value is equal to or greater than the reference value T5. Then, the controller 120 controls the heat lamp to maintain the temperature of 50° C. which has been preset for the second power saving mode. Thereafter, the process flow returns to the step 303 and maintains the second power saving mode. Meanwhile, if the printing data input or the control command data has been received from the PC interface 110 or the operating panel 140 at a time T6,the controller 120 executes the foregoing steps 305 to 327, so as to raise the fixing temperature up to the printing temperature. In this case, the wake-up time (T7–T6) required for raising the fixing temperature up to the printing temperature is longer than the wake-up time (T4–T3) at the first power saving mode. Meanwhile, If the printing data or the control command data has still not been generated at step 303, the controller 120 continues to count the print-waiting time to increase the counting value at step 313. Thereafter, if the counting value is equal to or greater than the reference value T8 which has been preset for the third power saving mode, the process flow proceeds to step 325 via the steps 317 and 321. At step 325, the controller 120 sets the current operation mode to the third power saving mode and executes the third power saving mode in the similar way as the first and second power saving modes. Namely, in the third power saving mode, the controller 120 completely turns off the heat lamp at a time T8 to reduce the fixing temperature, if the counting value is equal to or greater than the reference value T8. Then, the controller 120 controls the heat lamp to maintain the room temperature of 20° C. Thereafter, the process flow returns to the step 303 and maintains the third power saving mode. Meanwhile, if the printing data or the control command data has been received from the PC interface 110 or the operating panel 140, the controller 120 executes the foregoing steps 305 to 327, so as to raise the fixing temperature up to the printing temperature. In this case, the wake-up time required for raising the fixing temperature up to the printing temperature is substantially equal to the initial heating time T1.

As described in the foregoing, the present invention performs the first to third power saving modes step by step with the passage of the print-waiting time, so that the wake-up time may be reduced remarkably, thereby resulting into the power consumption.

Although a preferred embodiment of the present invention has been described in detail hereinabove, it should be clearly understood that many variations and/or modifications of the basic inventive concepts herein taught which may appear to those skilled in the art will still fall within the spirit and scope of the present invention as defined in the appended claims. For example, although the present invention is described with reference to a laser printer hereinabove, the same may be employed with another electrophotographic image forming apparatus. Further, if necessary, the power saving mode may be divided into more than 3 gradations.

What is claimed is:

1. A method of saving power step by step in an electrophotographic image forming apparatus, comprising the steps of:

raising a fixing temperature up to a print-waiting temperature when the electrophotographic image forming apparatus is turned on;

counting a print-waiting time when said fixing temperature reaches the print-waiting temperature;

comparing a counting value of the print-waiting time with reference values which are preset into three gradations; and lowering said fixing temperature to a temperature corresponding to said reference values step by step, if said counting value is equal to or greater than the reference values.

2. A method of saving power step by step according to claim 1, further comprising a step of resetting said counting value, if printing data or control command data is received during counting the print-waiting time.

3. A method of saving power step by step according to claim 2, said reference values being time values which increase with a passage of the print-waiting time.

4. A method of saving power step by step according to claim 3, said temperature corresponding to the reference values being lowered with the passage of the print-waiting time.

5. A method of saving power step by step in an electrophotographic image forming apparatus, comprising the steps of:

raising a fixing temperature up to a print-waiting temperature when the electrophotographic image forming apparatus is turned on, and maintaining the print-waiting temperature;

checking whether or not printing data or control command data has been received;

increasing a counting value with a passage of a print-waiting time, if the printing data or control command data has not been received;

comparing said counting value with reference values which are preset into three gradations;

setting a power saving mode to reduce power consumption to a value which is lower than a current power consumption, if the counting value is equal to or greater than the reference values; and increasing the fixing temperature up to a printing temperature to print or process the printing data and control command data, if the printing data or command data has been received.

6. A method of saving power step by step according to claim 5, said reference values being time values increasing with a passage of the print-waiting time.

7. A method of saving power step by step in an electrophotographic image forming apparatus, comprising the steps of:

raising a fixing temperature up to a print-waiting temperature when the electrophotographic image forming apparatus is turned on, and maintaining the print-waiting temperature;

checking whether or not printing data or control command data has been received;

increasing a counting value with a passage of a print-waiting time, if the printing data or control command data has not been received;

comparing said counting value with reference values;

setting a power saving mode comprising three gradations of first to third power saving modes to reduce power consumption to a value which is lower than a current power consumption, if the counting value is equal to or greater than the reference values; and increasing the fixing temperature up to a printing temperature to print or process the printing data and control command data, if the printing data or command data has been received.

8. A method of saving power step by step according to claim 7, said reference values being time values increasing with a passage of the print-waiting time.

9. A method of saving power step by step in an electrophotographic image forming apparatus, comprising the steps of:

raising a fixing temperature up to a print-waiting temperature when the electrophotographic image forming apparatus is turned on, and maintaining the print-waiting temperature;

checking whether or not printing data or control command data has been received;

increasing a counting value with a passage of a print-waiting time, if the printing data or control command data has not been received;

comparing said counting value with reference values;

setting a power saving mode to reduce power consumption to a value which is lower than a current power consumption, if the counting value is equal to or greater than the reference values, said power saving mode comprising three gradations of first to third power saving modes; and increasing the fixing temperature up to a printing temperature to print or process the printing data and control command data, if the printing data or command data has been received.

10. A method of saving power step by step according to claim 9, said reference values being time values increasing with a passage of the print-waiting time.

11. A method of saving power step by step in an electrophotographic image forming apparatus, comprising the steps of:

raising a fixing temperature up to a print-waiting temperature when the electrophotographic image forming apparatus is turned on, and maintaining the print-waiting temperature;

checking whether or not printing data or control command data has been received;

increasing a counting value with a passage of a print-waiting time, if the printing data or control command data has not been received;

comparing said counting value with reference values, said reference values being time values increasing with a passage of the print-waiting time;

setting a power saving mode to reduce power consumption to a value which is lower than a current power consumption, if the counting value is equal to or greater than the reference values, said power saving mode comprising three gradations of first to third power saving modes; and increasing the fixing temperature up to a printing temperature to print or process the printing data and control command data, if the printing data or command data has been received.

* * * * *